US005222812A

United States Patent [19]

Cuddy et al.

[11] Patent Number: 5,222,812

[45] Date of Patent: Jun. 29, 1993

[54] BULK CONTAINERS

[76] Inventors: Christopher C. Cuddy, Baneshane, Midleton, County Cork, Ireland; Thomas Noor, Hugelstrasse 9, D-6940 Weinheim, Fed. Rep. of Germany

[21] Appl. No.: 758,920

[22] Filed: Sep. 11, 1991

[30] Foreign Application Priority Data

Sep. 11, 1990 [IE] Ireland ..... 3294/90
Aug. 16, 1991 [IE] Ireland ..... 2914/91

[51] Int. Cl.[5] ..... B65D 30/10; B65D 33/02; B65D 33/14

[52] U.S. Cl. ..... 383/17; 383/24; 383/107; 383/119

[58] Field of Search ..... 383/119, 17, 24, 107

[56] References Cited

U.S. PATENT DOCUMENTS

| | | | |
|---|---|---|---|
| 3,949,901 | 4/1976 | Tokita . | |
| 4,136,723 | 1/1979 | Skaadel et al. . | |
| 4,207,937 | 6/1980 | Sandeman et al. | 383/17 |
| 4,703,517 | 10/1987 | Marino | 383/119 |
| 4,822,179 | 4/1989 | Nattrass | 383/26 |
| 5,071,025 | 12/1991 | Boots | 383/119 |
| 5,076,710 | 12/1991 | Derby | 383/107 |

FOREIGN PATENT DOCUMENTS

| | | | |
|---|---|---|---|
| 76102/74 | 6/1976 | Australia . | |
| 0047389 | 3/1982 | European Pat. Off. . | |
| 0105238 | 4/1988 | European Pat. Off. . | |
| 0118112 | 7/1989 | European Pat. Off. . | |
| 0441720A1 | 8/1991 | European Pat. Off. . | |
| 8800133.4 | 3/1988 | Fed. Rep. of Germany . | |
| 8900271 | 9/1990 | Netherlands | 383/24 |
| 754708 | 8/1956 | United Kingdom . | |
| 1431581 | 4/1976 | United Kingdom . | |
| 1431582 | 4/1976 | United Kingdom . | |
| 1455874 | 11/1976 | United Kingdom . | |
| 1484984 | 9/1977 | United Kingdom . | |

OTHER PUBLICATIONS

"Norsk Hydro Fertilizers—Fertilizer Handling", published by Norsk Hydro Fertilizers Ltd., Ipswich, England, (not dated).

"Harpak Big Bags/Pratiksac", published by Harpak Import-Export-Plastics, Hillegom, Netherlands (not dated).

"Lolift—the proven flexible semi-bulk container", published by Lolift (U.K.) Ltd., Knaresborough, England (not dated).

*Primary Examiner*—Stephen P. Garbe
*Attorney, Agent, or Firm*—Skjerven, Morrill, MacPherson, Franklin & Friel

[57] ABSTRACT

A bulk container of flexible fabric having a substantially rectangular base and four walls with four corners at the junctions of the walls has four interior bridging panels extending between adjacent walls across the corners, the bridging panels each being formed of fabric which is integral with part of said adjacent walls. In one embodiment, the four bridging panels and the four wall centre panels are formed of a single main piece of fabric, and the corners are formed by corner pieces attached to the main piece of fabric at the junctions between the bridging panels and the wall centre panels. The corner pieces each comprise a folded strip of fabric which forms a lifting device. Holes are cut through the bridging panels by laying the main piece of fabric in doubled condition and cutting two layers in one operation. The container has a pyramid shaped top cover with a central filing chute, and an outlet chute.

In other embodiments, each bridging panel forms part of an integral corner unit and the shell of the bag is formed by joining four corner units and four wall centre panels. Other forms of lifting device are also described.

5 Claims, 12 Drawing Sheets

BULK CONTAINERS

BACKGROUND OF THE INVENTION a) Field of the Invention

This invention relates to intermediate bulk containers (also known as "Big Bags") of flexible woven fabric, particularly for use with flowable materials in powder, granular or flake form, such as bulk chemicals, plastics in raw form and the like.

b) Description of the Related Art

Flexible bulk containers are well known, as exemplified by U.S. Pat. No. 4,136,723, or E.P. 0,047,389 A1. It is widely recognised that the walls of flexible bulk containers filled with flowable materials curve outwardly and tend towards a circular shape in horizontal cross section, even though the base may be square. However the storage or transportation of materials in circular bags is very wasteful of space. It has therefore been proposed to make bags with a construction such that they will adopt a square or rectangular shape when filled. One known bag from Haberl of Austria has walls forming a square and bridging panels across each of the corners, these bridging panels being provided with apertures so that powder can flow into the triangular spaces at the corners. However the known bag is made up from a multiplicity of separate panels of fabric, which is disadvantageous both during manufacture and in use.

SUMMARY OF THE INVENTION

The present invention provides a bulk container of flexible fabric having a substantially rectangular base and four walls with four corners at the Junctions of the walls, and four interior bridging panels extending between adjacent walls across the corners, wherein the bridging panels are each formed of fabric which is integral with part of said adjacent walls. The bag according to the invention uses significantly less panels of fabric than the known bag mentioned above, which leads to simplicity in manufacture and a reduction in the number of potential lines of weakness along seams.

In one type of bag in accordance with the invention, the fabric of each bridging panel is integral with the fabric of those parts of the walls which meet at the respective corners.

Preferably in this type of bag each bridging panel and the panels which meet at the respective corner are formed as an integral corner unit from a tubular blank, more particularly of circular woven fabric. The shell of the bag may suitably be formed by joining four corner units and four wall centre panels.

In a second type of bag in accordance with the invention, each wall comprises a centre panel and two corner panels, and the fabric of each bridging panel is integral with the fabric of the centre panel of each wall. Preferably the four bridging panels and the four wall centre panels are formed of a single main piece of fabric, more particularly of circular woven fabric. This type of bag has the extra advantages: of further simplification in manufacture because all of the bridging panels and wall centre panels can be cut from a single main piece of fabric in one operation; and of increased strength resulting from the continuity of fabric from each bridging panel to the adjacent wall centre panels.

In the second type of bag, corners are suitably formed by four corner pieces attached to the main piece of fabric at the junctions between the bridging panels and the wall centre panels.

In both types of bag, lifting devices are provided at the corners. The lifting devices may be joined to the fabric at the corners or may be formed by extension of the fabric at the corners.

In one preferred embodiment of the second type of bag, each corner piece comprises a single strip of fabric folded at the top and joined along one edge to itself and along the other edge to the main piece of fabric of the bag.

In another embodiment of the invention, the wall panels which meet at each corner are provided with a pair of reinforced vertical bands woven into the fabric on either side of the corner, and a lifting device in the form of a doubled-over belt is joined to the fabric at the reinforced vertical bands.

In both types of bag, holes are cut through the bridging panels. These holes may be square, rectangular, elliptical, circular or segments of a circle. In the preferred embodiment the holes are in vertical columns while horizontal bands of fabric remain across each bridging panel between the holes.

In a preferred method of making the bridging panels, fabric is laid in doubled condition and cut through two layers in one operation.

The fabric may suitably be any fabric conventionally used in Big Bags e.g. woven polypropylene. Preferably said substantially rectangular base of the bag is substantially square, in either type of bag.

According to one aspect of the present invention a bulk container has a pyramid-shaped top cover with an inlet chute at the centre thereof.

BRIEF DESCRIPTION OF THE DRAWINGS

Several embodiments of the invention are illustrated in the accompanying drawings in which.

DESCRIPTION OF THE PREFERRED EMBODIMENTS

Figure 1:
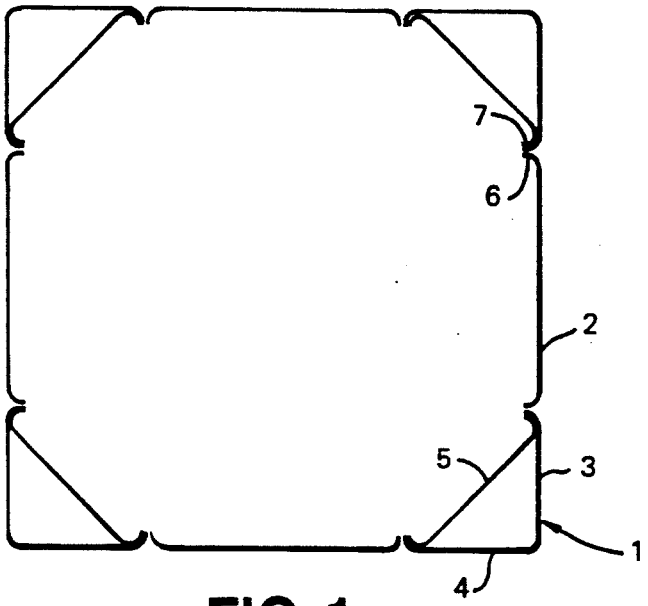
FIG. 1 is a diagrammatic plan view of the fabric portions for the walls of an inside-seamed bag of the first type, the spacing of the fabric portions at the seams being exaggerated, for clarity of representation.
Figure 2:
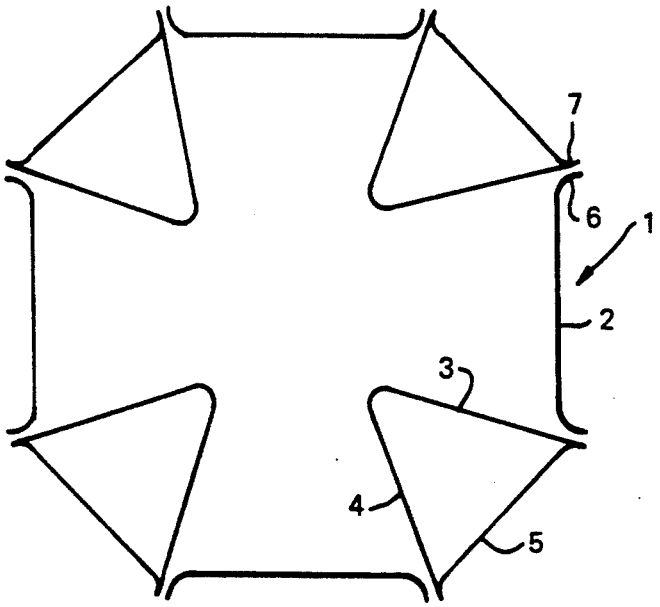
FIG. 2 is a diagrammatic plan view of the walls of the bag of FIG. 1 during manufacture, which takes place in essentially an inside-out condition, to facilitate stitching the seams.

As shown in FIGS. 1 and 2, the shell of a bag of the first type comprises four corner units and four centre wall panels 2 stitched together at inturned vertical edges of each adjacent piece.

Each corner unit 1 is formed of a single piece of tubular fabric, either circular woven fabric (preferred) or lay-flat fabric joined to form a tube. The corner unit 1 comprises two corner panels 3, 4 which when the bag is full define an approximately right-angled corner, and a bridging panel 5 which forms the hypotenuse of the triangle.

Each wall centre panel 2 is made from circular or lay flat fabric cut to the same height as the corner panels 3, 4. The inturned edges 6 of the wall centre panels are stitched to inturned edges 7 of the corner units at the ends of the bridging panels. For practical manufacturing reasons, the actual assembly of the various panels and the stitching of the seams takes place in the inside-out configuration of the bag shown in FIG. 2. Thus for stitching, the seams of the bag are directed outwardly. Following stitching, the stitched-together tubular structure as depicted in FIG. 2 is turned inside out to provide the arrangement shown in FIG. 1, in which the eight vertical seams at 6 and 7 face inwardly.

Figure 3:
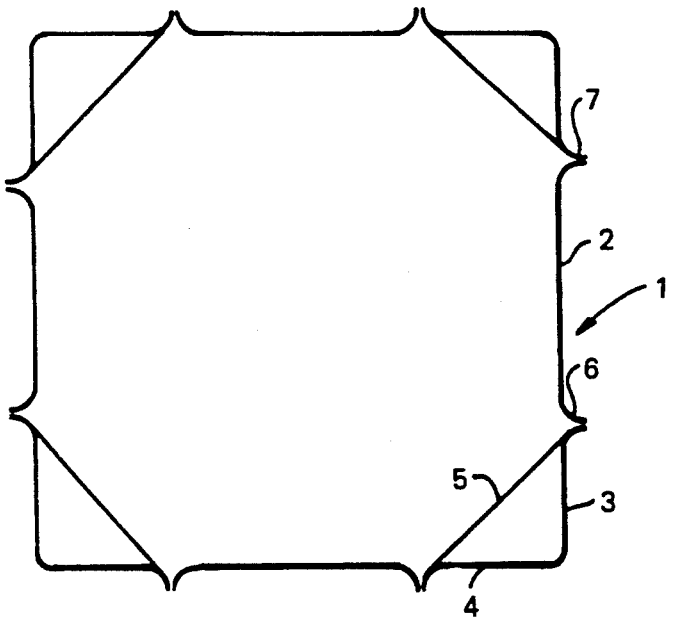
FIG. 3 is a diagrammatic plan view of the fabric portions for the walls of an outside-seamed bag of the first type before stitching.

FIG. 3 shows an alternative outside-seamed construction of a bag of the first type, which is substantially identical with the arrangement of FIG. 1 except that the seams 6, 7 are directed outwardly. In this case again, each wall centre panel 2 is made from circular or lay flat fabric cut to the same height as the corner panels 3, 4. The out-turned edges 6 of the wall centre panels 2 are stitched to the out-turned edges 7 of the corner units at the ends of the bridging panels. In this construction of the bag of the invention, stitching of the outwardly-directed seams results in the final bag shell being achieved without any necessity for reversal of the stitched structure at any stage during the manufacturing process, in contrast to the arrangement described in regard to FIGS. 1 and 2.

Figure 4:
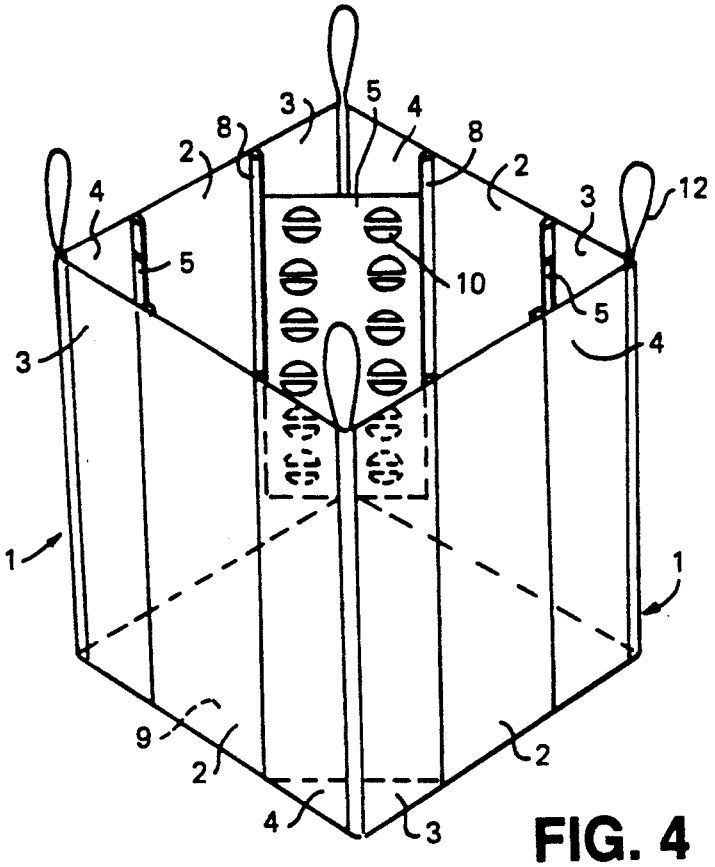
FIG. 4 is a projection of a first embodiment of a bag having lifting belts.

FIG. 4 shows a finished bag of the first type as depicted in FIG. 1. Four corner units 1 have been joined to four centre panels 2 at seams 8 to form the shell of the bag and a square base 9 has been sewn into the bag in conventional manner.

Each bridging panel 5 has been cut at the top and the bottom so that it is of reduced height compared to the height of the corner panels 3, 4 and the centre panels 2. Holes 10 have been cut through the fabric of each bridging panel. These holes may be circular. square, rectangular or elliptical. As shown in the drawings, the holes 10 are two segments of a circle separated by a band 11 of fabric whose edges are chords of the circle. The holes 10 are arranged in two columns with the bands 11 aligned so that wefts are continuous across the panel in the bands and also in the spaces between holes in each column. These wefts then continue into the corner panels 3, 4. Just one column of holes 10 may be provided in alternative constructions, or, in further variants, three or more columns.

Figure 5:
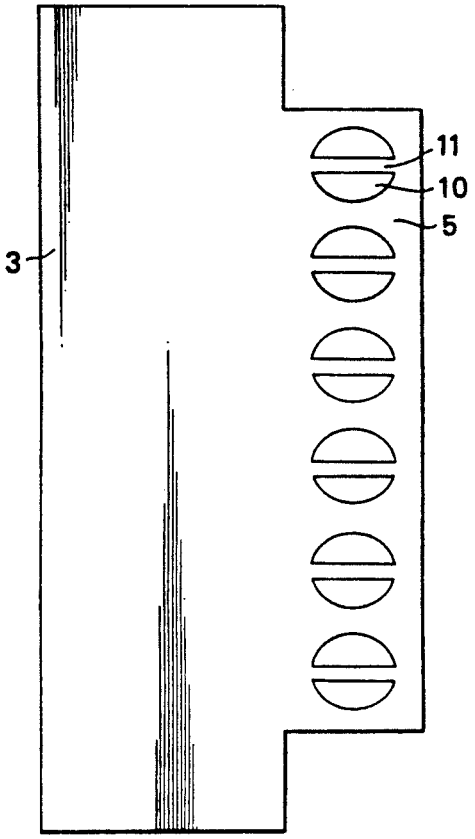
FIG. 5 is a cutting diagram of the fabric for a corner unit of the embodiment of FIG. 4.

As shown in FIG. 5 each corner unit is cut from a single tubular piece of fabric laid in double thickness. The fabric for one corner panel 3 and one vertical half of the bridging panel 5 are visible in FIG. 5. The portions of fabric above and below the bridging panel have been cut away and two columns of holes have been cut through the doubled fabric in a single operation. This profiling of the corner unit in one operation facilitates easy manufacture and ensures that the bands 11 are aligned in the two columns of holes.

In the embodiment of FIG. 4, the lifting devices are belts 12 of conventional type, doubled over and sewn along the corner of each corner unit for the full height of the bag, or over a lesser vertical distance if appropriate. The belt suitably lies against one corner panel 4 and is sewn by stitching passing through both of the corner panels 4 and 3, with added reinforcement if desired.

Figure 6:
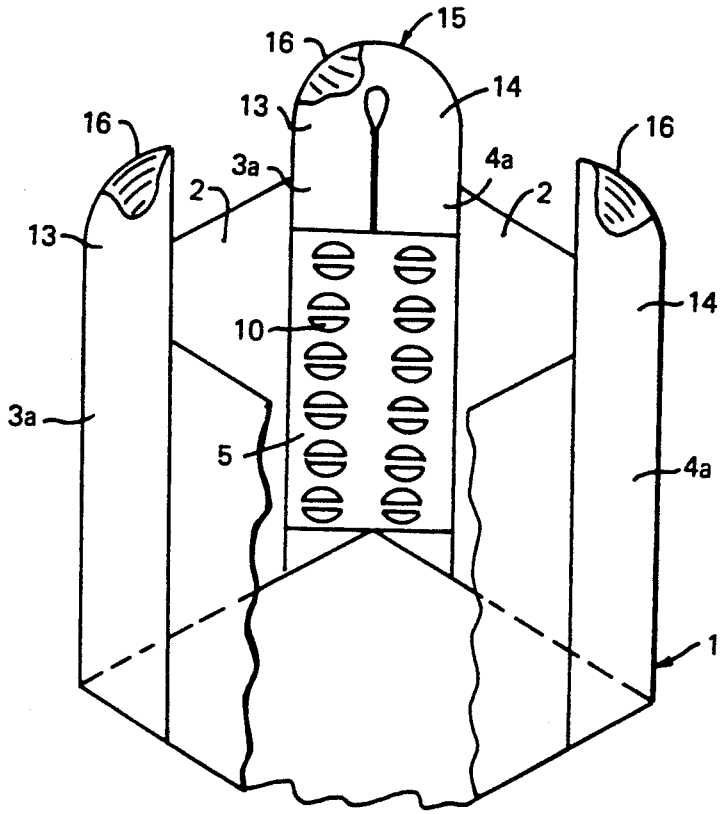
FIG. 6 is a projection (with one corner cut away) of a second embodiment of a bag of the first type, having lifting handles formed of the fabric of the corner units.

The embodiment of FIG. 6 is the same as that of FIG. 4, except that there are no lifting belts 12 but the corner panels 3*a*, 4*a* are extended upwardly into handle portions 13, 14, the top ends of which are brought together in overlapping relationship and stitched together to form a lifting handle 15. The fabric is cut between portions 13 and 14 to form an opening and thereby define the lifting handle. The fabric can be gathered or folded together prior to or subsequent to sewing. A sleeve 16 of fabric is formed around the joint in the lifting handle by wrapping fabric around the handle and stitching it to itself alongside the handle, or alternatively the handle may be taped.

Figure 7:
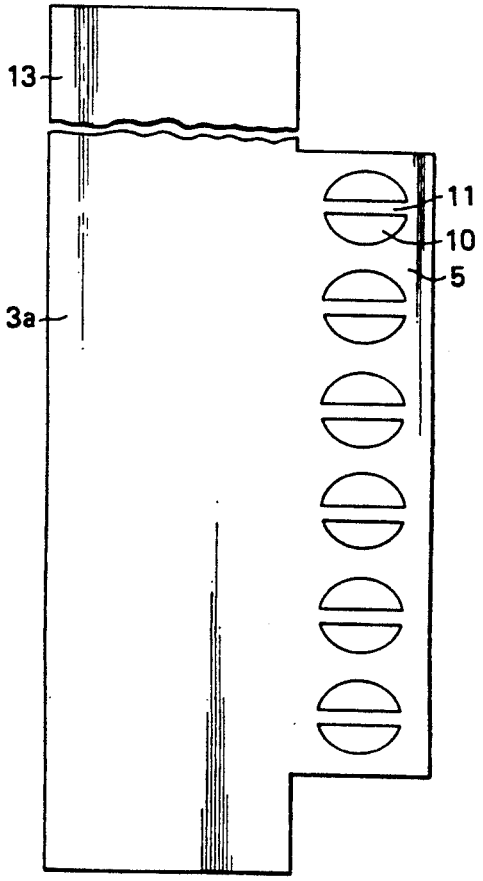
FIG. 7 is a cutting diagram of the fabric for a corner unit of the embodiment of FIG. 6.

FIG. 7 is a cutting diagram similar to FIG. 5 but showing the extended handle portion 13 of the corner panel 3*a*. The embodiment of FIGS. 6 and 7 has the advantage that the lifting handle is integral with the corner unit and all of the warp tapes of the corner panels 3, 4 form the lifting handle.

Figure 8:
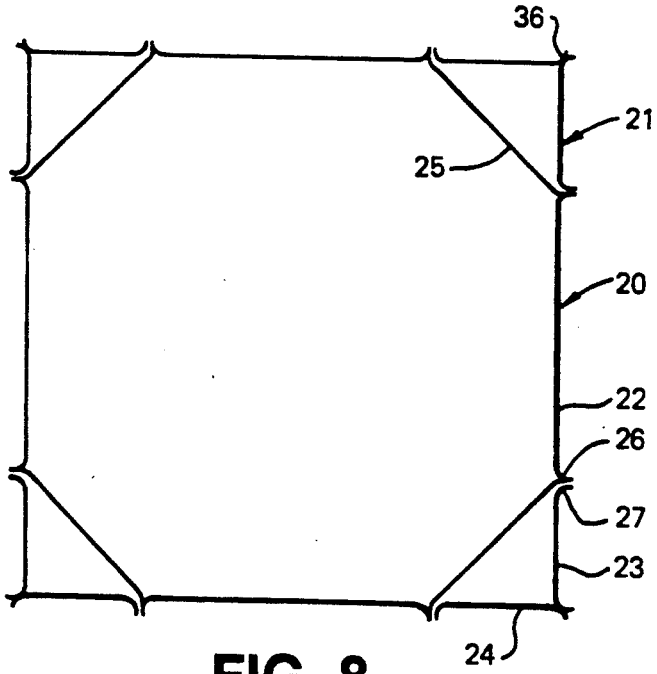
FIG. 8 is a diagrammatic plan view of the fabric portions for the walls of an outside-seamed bag of the second type, before stitching.
Figure 11:
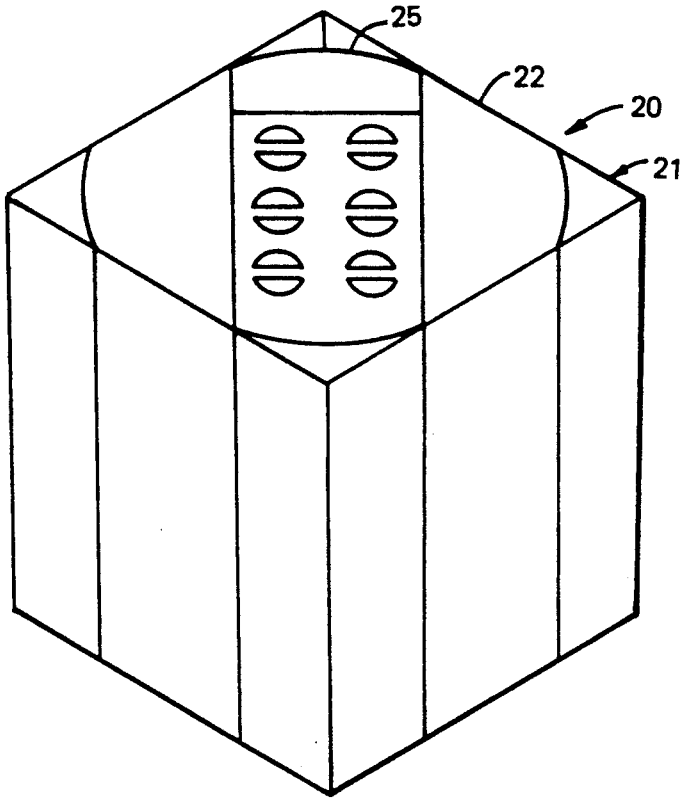
FIG. 11 is a diagrammatic projection of a bag of the second type, omitting the lifting handles.

As shown in FIGS. 8 and 11, a bag of the second type comprises a single main-piece of fabric 20 forming the four wall centre panels 22 and the four bridging panels 25. The four corners are formed by separate corner pieces 21 which are stitchable to the main piece of fabric 20 at out-turned vertical edges 27 of the corner pieces and eight outwardly projecting folded strips 26 of the main piece. The main- piece of fabric 20 is circular woven fabric. The corner pieces 21 are circular woven or lay flat fabric cut and folded to form corner panels 23, 24 which in the filled condition of the bag define an approximately right-angled corner. The bridging panel portions 25 of the main piece 20 form the hypotenuse of the triangle with the corner panels 23, 24.

The bag of FIGS. 8 and 11 is an outside-seamed unit, which may be manufactured directly when its constituent portions are assembled in accordance with FIG. 8. No reversal of the structure is required.

Figure 9:
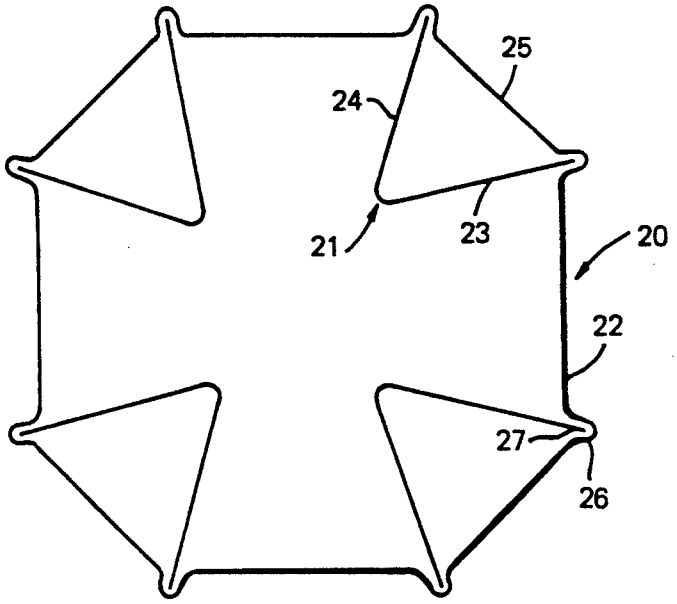
FIG. 9 is a diagrammatic plan view of the fabric portions for the walls of an inside-seamed bag of the second type during manufacture, which takes place in an inside-out condition so as to facilitate stitching of the seams.
Figure 10:
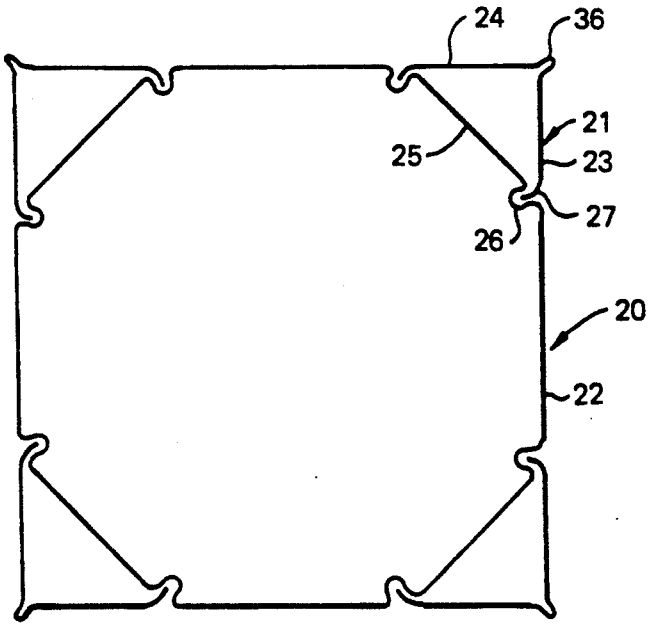
FIG. 10 is a diagrammatic plan view of the fabric portions for the walls of the inside-seamed bag of FIG. 9, following reversal from its inside-out condition into its normal disposition for use, the fabric spacing at the seams being exaggerated for clarity of representation.

In similar manner to the manufacturing method already described in regard to FIGS. 1 and 2, an inside-seamed bag of the second type may also be produced. A bag of this kind is shown in FIGS. 9 and 10. FIG. 9 depicting the preliminary manufacturing stage when the constituent or component parts are pre-assembled in a generally inside-out configuration so that the seams of the structure are outwardly extending for convenience in sewing. As shown in FIG. 9, the four corners are formed by separate corner pieces 21, which are stitchable to the main piece of fabric 22. The corner pieces 21 are placed inside the generally tubular main piece, and each vertical edge 27 of the corner piece is sewn into a folded strip 26 of the main panel 22. After the eight vertical strips at 26 and 27 have been sewn, the main body is then turned inside out or reversed. The corner pieces are then located on the exterior of the bag, as shown in FIG. 10. End the eight folded strips or seams defined at 26, 27 project inwards into the bag.

An inside-seamed bag provides a structure of generally more attractive external appearance, as well as which no projecting material portions extend outwardly from the bag such as might snag or catch on any potentially damaging article or object.

Figure 12:
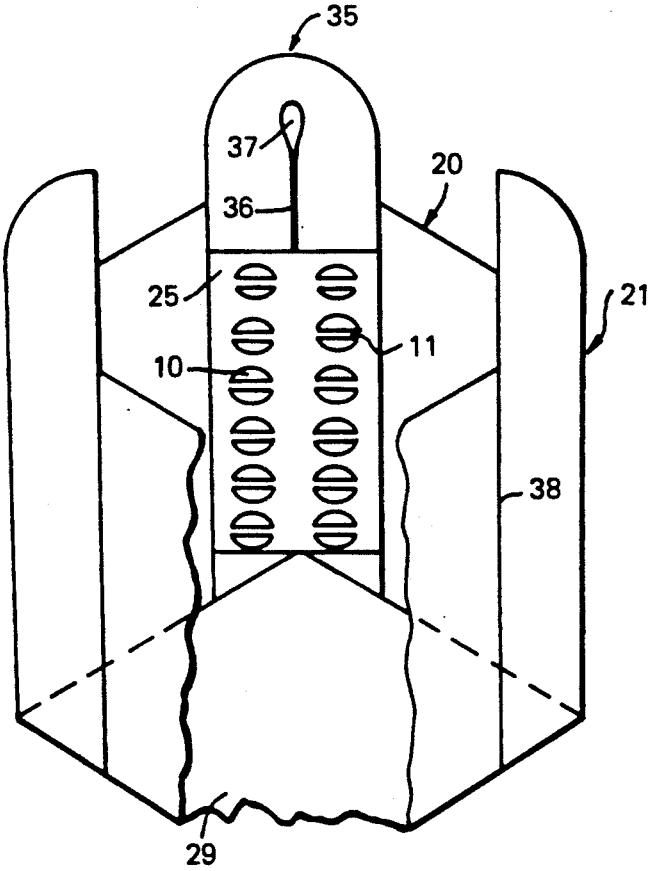
FIG. 12 is a projection (with one corner cut away) of a third embodiment of a bag, being a bag of the second type with lifting handles.

FIG. 12 shows a bag of the second type (with one corner cut away). The four corner pieces 21 have been joined to the main piece 20 to form the shell of the bag and a substantially square base 29 has been sewn to the bag in a conventional manner.

Figure 13:
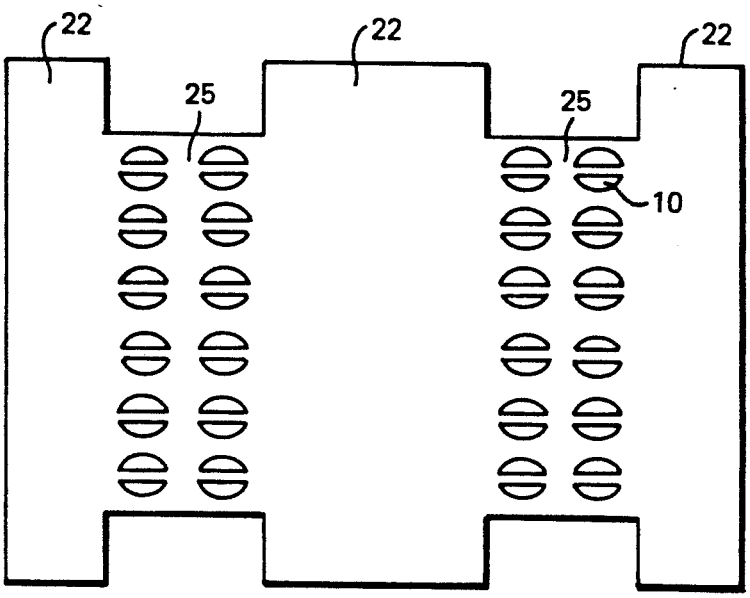
FIG. 13 is a cutting diagram of the fabric for the main wall and bridging panels for the bag of FIG. 12.

Although the bridging panels 25 form part of the main piece 20, they have been cut to reduced height and provided with holes 10 separated by bands 11 similar to those in the embodiments of FIGS. 4 and 6. As shown in FIG. 13, the main piece 20 is cut from a single circular woven portion of fabric laid in double thickness. The fabric for two bridging panels 25, one centre panel 22 and two vertical halves of centre panels 22 is visible in FIG. 13. The portions of fabric above and below the bridging panels have been cut away and the holes 10 have been cut through the two layers of fabric in one operation, as for the embodiments of FIGS. 4 and 6.

Figure 14:
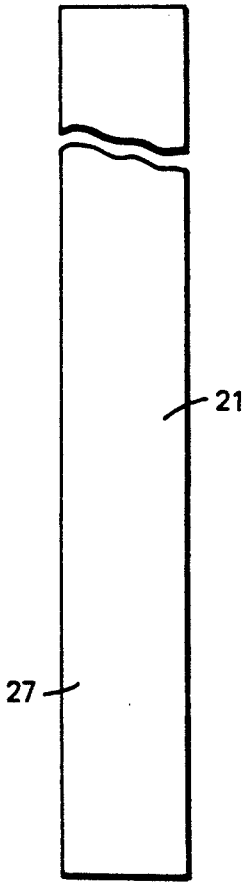
FIG. 14 is a cutting diagram for the corner panels for the bag of FIG. 12.

The corner pieces 21 are each formed from a single strip of fabric (FIG. 14) having a length twice the desired height of the corner piece and lifting handle 35. The strip of fabric has been folded in the middle so that the fold is at the top of the lifting handle and the outside edges of the strip have been sewn together for most of their length along a seam 36 but leaving an unsewn portion at the top, near to the fold, so that an opening 37 is formed for insertion of a lifting device. The inside edges 27 of the strips have been sewn to folded strips of the main piece 20 at seams 38. The fabric at the top of the lifting handle may be tied, reinforced, gathered, surrounded by a sleeve or left loose All of the warp tapes of the corner piece are included in the lifting handle.

Figure 15:
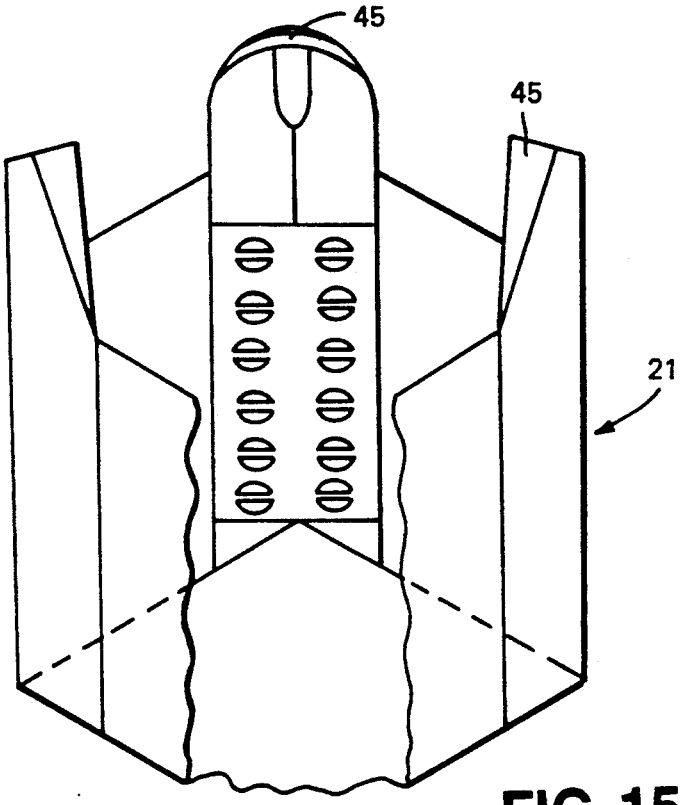
FIG. 15 is a projection (with one corner cut away) of a fourth embodiment of a bag, being a bag of the second type with twisted lifting handles.

The embodiment of FIG. 15 is the same as that of FIG. 12 except that the strip 21 has been twisted edge-to-edge at the time of folding so that the lifting handle 45 is formed of the twisted portion (see FIG. 16). twists may be formed, if desired, to form a tighter handle.

The bag shown in FIGS. 17-20 is similar to that of FIG. 15. The fabric portions for the walls (FIG. 19) are similar to those of FIG. 8 except that the edges of each corner piece 21 have been hemmed for added strength before being sewn together at seams 36 or being sewn to folded strips of the main piece 20 at seams 38. The cutting pattern for the main piece 20 (FIG. 20) is similar to that of FIG. 13 except that the pairs of segmental holes 10 in the bridging panels 25 have been replaced by rectangular holes 10*a* arranged in 2 columns with bands 11*a* across the bridging panels between the holes. The wefts of these bands 11*a* extend continuously into the centre panels 22. As an optional extra feature the locations for the seams 38 have been marked by warp tapes 40 which are coloured differently from the remainder of the fabric either by inherent colour or by marking with ink or the like, to facilitate assembly of the corner pieces 21 to the main piece 20 at the correct locations. Portions of the fabric at the top and bottom of the bridging panels have been cut away but the pairs of vertical cutting lines 42 are separated from one another by less than the separation of the coloured warp tapes 40, so that a strip 43 of fabric of the bridging panel extends alongside the seam 38 for the full height of the wall (see FIG. 18).

Figure 20:
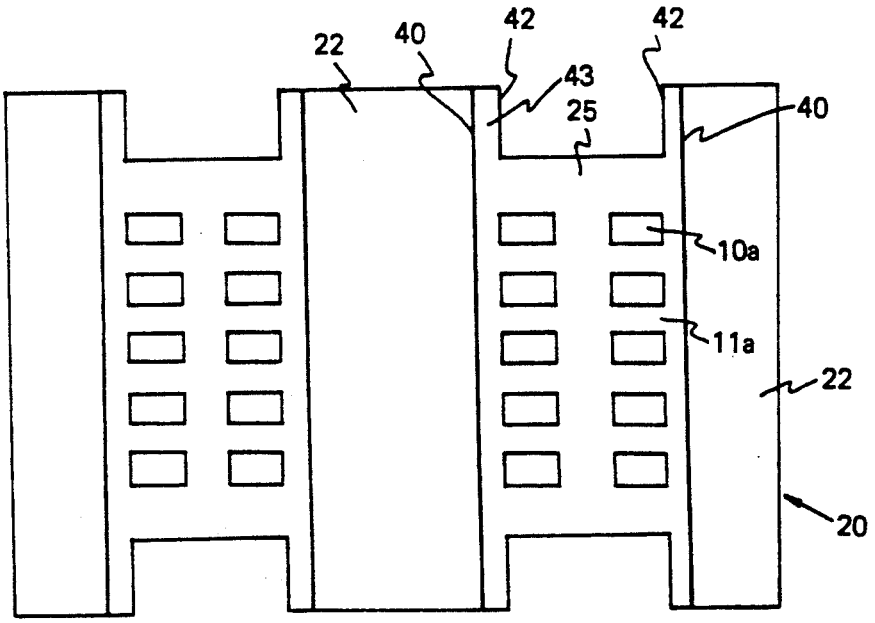
FIG. 20 is a cutting diagram of the fabric for the main wall and bridging panels for the bag of FIGS. 17 and 18.

As described with reference to FIG. 13, the main piece 20 is cut from a circular woven portion of fabric laid in double thickness. Therefore FIG. 20 shows the pattern for one half of the total main piece which is produced from the two layers of fabric.

Figure 16:
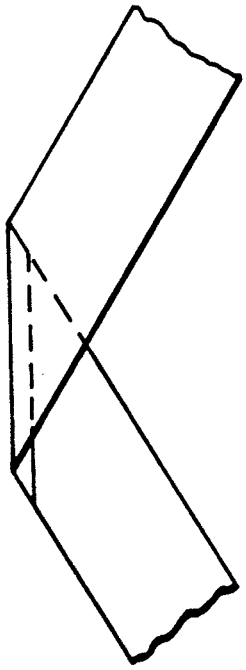
FIG. 16 is a diagram of the twisted portion of a lifting handle of the bag of FIG. 15.

Each lifting handle 45 is formed of the strip 21 which has been twisted at the time of folding (as in FIG. 16). The twisted and gathered fabric at the top of each lifting handle is enclosed in a sleeve 44 of plastics material as known in the art for lifting handles.

The bag has a pyramid-shaped top cover 46 with a central filling chute 47. Both the cover 46 and the chute 47 are made of woven polypropylene fabric of lighter grade than the walls of the bag. The cover 46 comprises four panels sewn together at their edges 49 and sewn to the top of the four walls of the bag at seam 50. The converging quadrilateral panels 49 may be cut from a piece of fabric in alternating inverted sequence so that no fabric is wasted. The chute 47 comprises a tube of circular woven fabric or seamed lay flat fabric, which is joined to the four panels of the cover 46 at their top edges by seam 51. A tape 52 is provided on the chute 47 for tieing the chute to close it after the bag has been filled. The top cover 46 and chute 47 aids in filling the bag to its full capacity. After filling, the cover and chute are folded down on top of the contents of the bag.

If desired, an additional belt of webbing may be provided at the top edge of the walls of the bag, in line with the seam 51.

The bag has a base comprising a square panel 53 joined to the bottom of the four walls at seam 59. The base has a central aperture 54 which communicates with an outlet chute 55. The base panel 53 is of similar fabric to the walls, while the outlet chute 55 is of lighter grade. A tape 56 is attached to the chute for tieing it closed, while a rope 57 is threaded through hemmed edges of the panel 53 around the aperture 54. An extra flap 58 of fabric is attached inside the aperture. Before use of the bag the outlet chute 55 (tied closed by tape 56) is pushed inside the bag, the flap 58 is inserted into the aperture, and the rope 57 is tightened to close the aperture. This procedure is reversed to empty the bag after filling.

Figure 17:
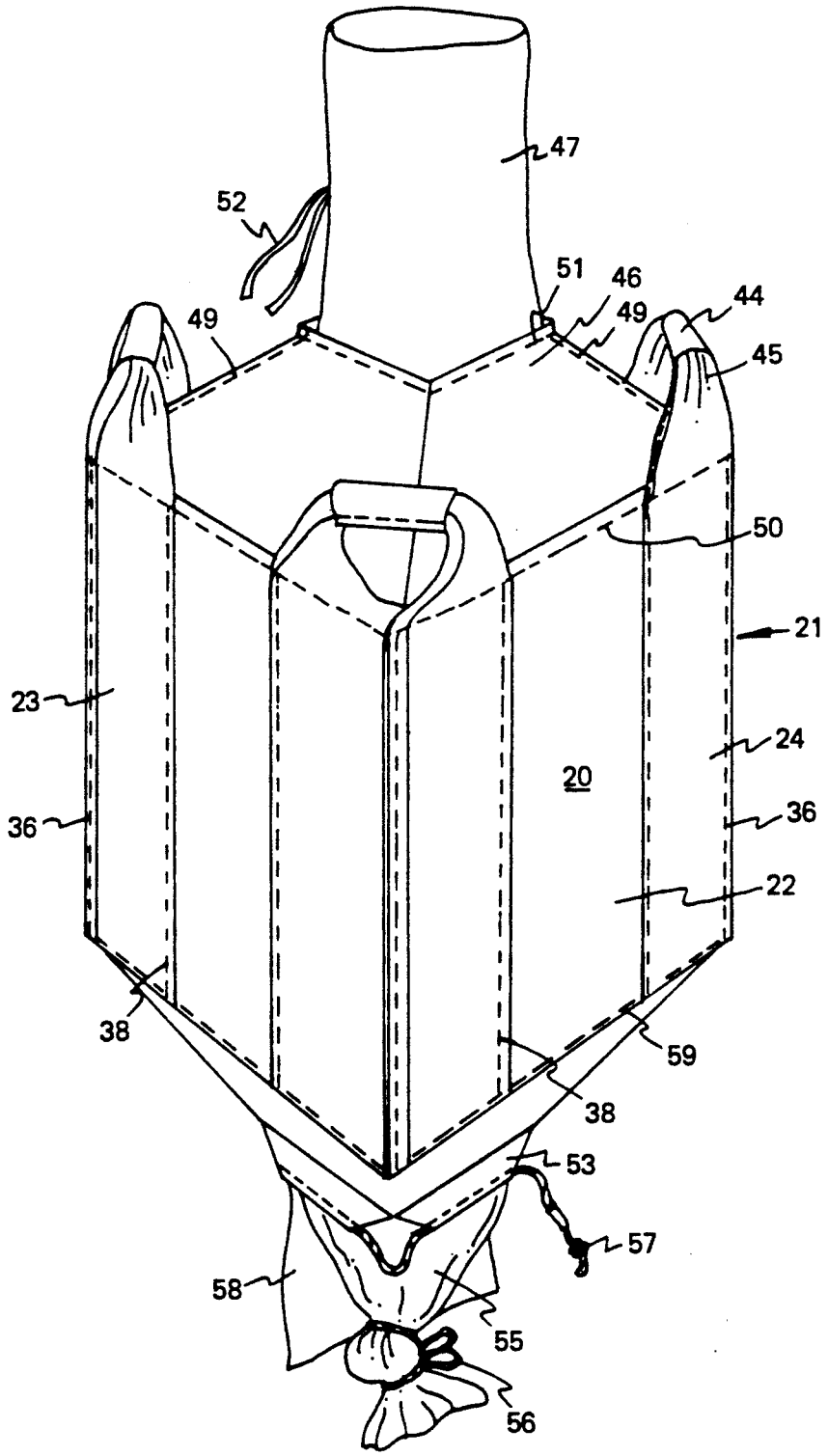
FIG. 17 is a projection of a fifth embodiment of a bag, being a bag of the second type similar to that of FIG. 15.
Figure 18:
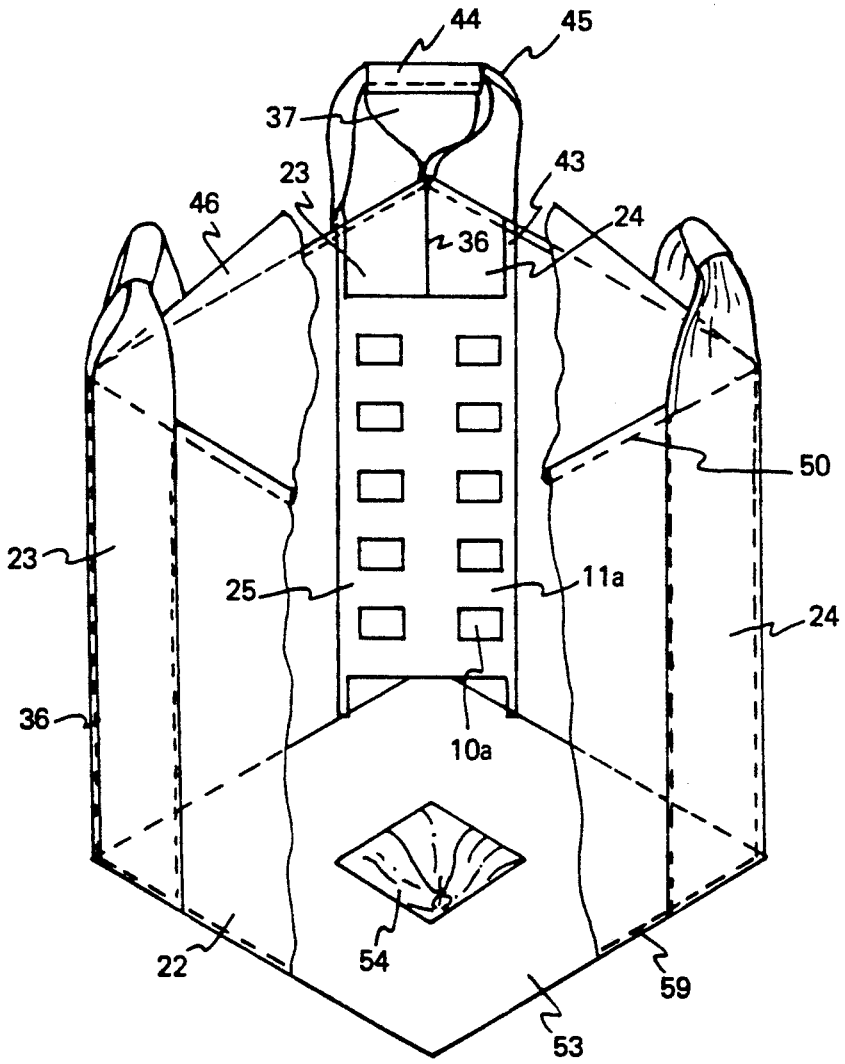
FIG. 18 is a projection (.with one corner and part of the top cover cut away) of the bag of FIG. 17.
Figure 19:
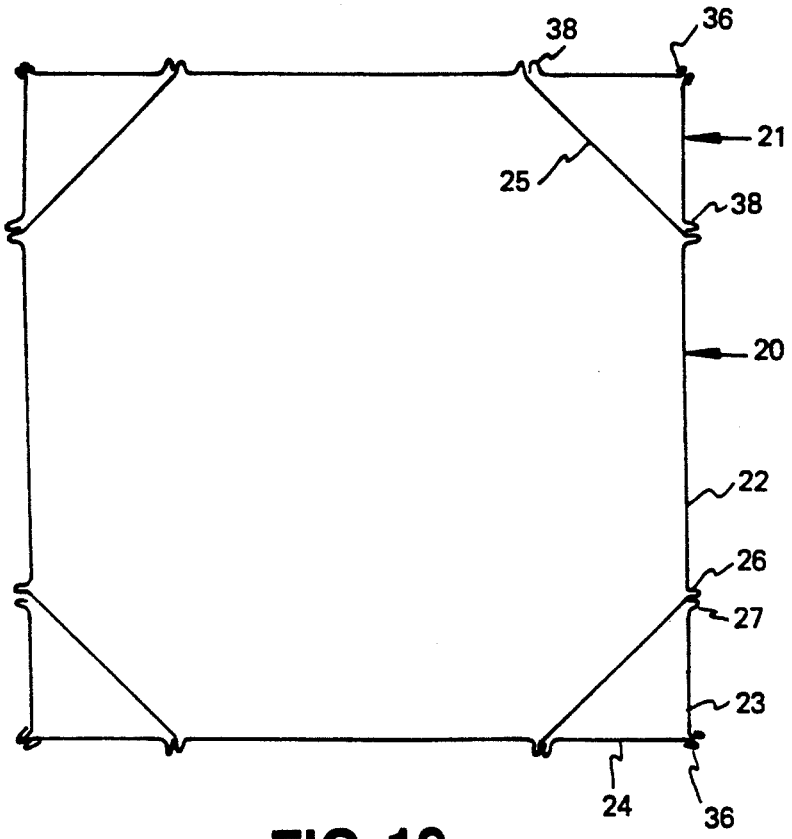
FIG. 19 is a diagrammatic plan view of the fabric portions for the walls of the bag of FIGS. 17 and 18.

The out-turned strips of fabric joined by the seams 38 (see FIG. 19) are held flat against the wall panels 22 by the stitching of seams 51 and 59 (see FIG. 17). This avoids the risk of outwardly-projecting portions snagging or catching on other objects.

Figure 21:
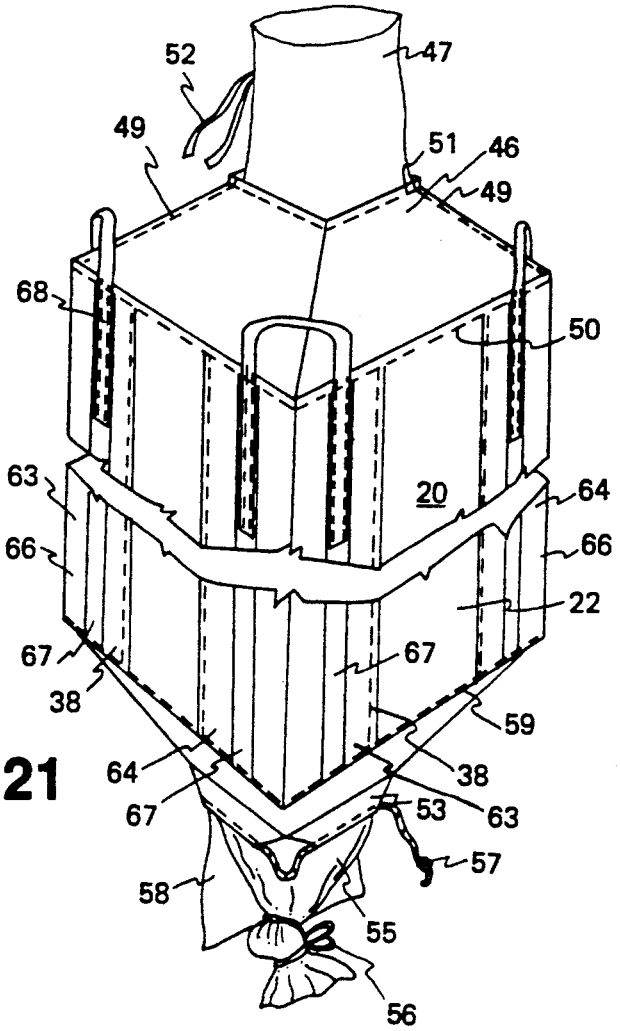
FIG. 21 is a projection similar to FIG. 17 of a sixth embodiment, of a bag, being a bag of the second type.
Figure 22:
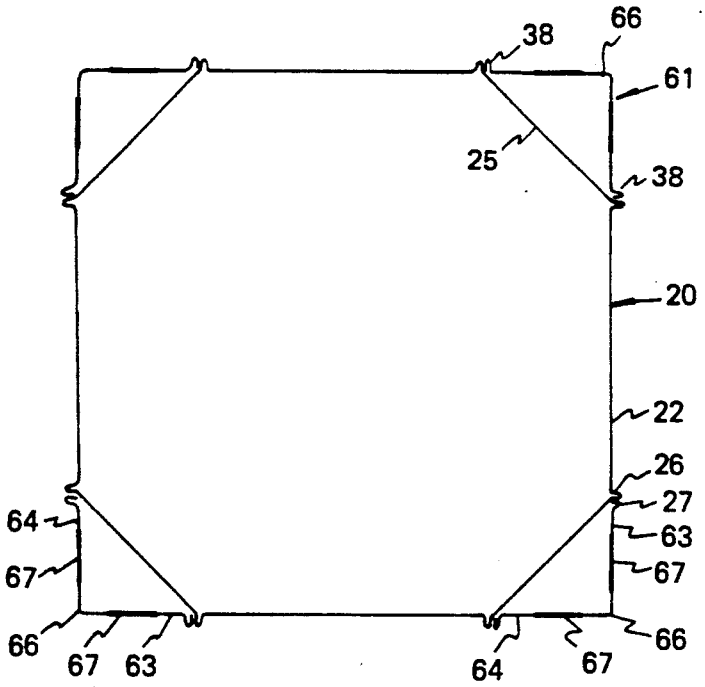
FIG. 22 is a diagrammatic plan view of the fabric portions for the walls of the bag of FIG. 21.

FIGS. 21–22 show a further embodiment which is similar to that of FIGS. 17–20 except that it has a different arrangement of the corner pieces and lifting handles.

Each corner piece 61 comprises a piece of lay flat fabric forming two corner panels 63, 64 which when the bag is full define an approximately right-angled corner 66. The corner pieces 61 do not extend above the wall panels 22. A vertical reinforced band 67 is woven into each of the corner panels 63, 64 by doubling or trebling the number of warp tapes in the band. The band may suitably be about 8–9 cm. wide and extend for the full height of each corner panel.

Lifting handles are formed by doubled-over belts 68 of webbing. The belts are sewn to the reinforced bands 67, with one end of each belt joined to a respective corner panel 63 and the other end of the belt joined to the adjacent corner panel 64. As shown in FIG. 21, the belts 68 extend for about 60 cms down from the top of the corner pieces 61, although they may extend for the full height of the bag if desired. The belts may be provided with protective sleeves at the lifting points, if desired.

A bag according to this embodiment may be significantly taller than those of the previous embodiments.

When a bag in accordance with the invention is charged with flowable material, the material flows under and through the bridging panels so that the triangular spaces at the corners are filled. The bridging panels hold the walls of the bag against bulging so that it retains a substantially square horizontal cross section and the filled bag is generally cubic in shape. The number and/or strength of the warp tapes in the bridging panels can be reduced as they do not carry any vertical load.

The above description relates to bags which are square in horizontal cross section e.g. having each wall of 105 cms length. The height of the walls of the bag may suitably be in the range 100–110 cms, or in the case of the embodiment of FIGS. 21–22 about 200 cm.

The invention is also applicable to bags in which the substantially rectangular base has a rectangular configuration other than square, namely one in which two of the sides of the base are longer than the other two sides of the base e.g. having one pair of opposed walls with a length from 95–115 cms while the other pair of sides has a length of 105 cms. The height of the walls of the bag may again be in the range 100–200 cms. In this instance, in use of the bag, the material filled again flows into the generally triangular corner regions of the bag and forces the bag to take up a substantially rectangular solid shape in its filled condition. This construction of the bag of the invention is equally as effective as square-based bags and provides a filled shape especially suited to certain transport and storage requirements where a square-section bag would be less appropriate.

We claim:

1. A bulk container of flexible fabric having a substantially rectangular base and four walls with four corners at the junctions of the walls, and four interior bridging panels extending between adjacent walls across the corners, wherein:

each wall comprises a wall centre panel and two corner panels;

the four bridging panels and the four wall centre panels are formed of a single integral main piece of fabric;

the corners are defined by the corner panels of adjacent walls;

the two corner panels at each corner are formed by a corner piece comprising a single strip of fabric folded at the top and joined along most of one edge to itself and along the other edge to the main piece of fabric of the bag; and wherein a lifting device is formed by the folded portion of the strip of fabric extending above the walls.

2. A container according to claim 1 wherein the single integral main piece of fabric is of circular woven fabric.

3. A container according to claim 1 wherein each strip of fabric forming the lifting device has been twisted at the time of folding.

4. A container according to claim 1 wherein holes are cut through the bridging panels, continuous bands of fabric remaining across each bridging panel between the holes, and portions of fabric at the top and bottom of the bridging panels are cut away.

5. A container according to claim 1 having a pyramid-shaped top cover with an inlet chute at the centre thereof.

* * * * *